US010232422B2

(12) United States Patent
Shao

(10) Patent No.: US 10,232,422 B2
(45) Date of Patent: Mar. 19, 2019

(54) COMPOSITE TUBE AND MANUFACTURING METHOD THEREOF

(71) Applicant: Metal Industries Research & Development Centre, Kaohsiung (TW)

(72) Inventor: Shun-Yu Shao, Kaohsiung (TW)

(73) Assignee: METAL INDUSTRIES RESEARCH & DEVELOPMENT CENTRE, Kaohsiung, Taiwan (CN)

( * ) Notice: Subject to any disclaimer, the term of this patent is extended or adjusted under 35 U.S.C. 154(b) by 275 days.

(21) Appl. No.: 14/955,115

(22) Filed: Dec. 1, 2015

(65) Prior Publication Data

US 2016/0151818 A1 Jun. 2, 2016

(30) Foreign Application Priority Data

Dec. 2, 2014 (TW) ..... 103141765 A

(51) Int. Cl.

| | |
|---|---|
| ***B21C 23/22*** | (2006.01) |
| ***B21C 33/00*** | (2006.01) |
| ***B21C 25/08*** | (2006.01) |
| ***B21C 23/08*** | (2006.01) |
| ***B21C 23/12*** | (2006.01) |
| ***B21C 35/02*** | (2006.01) |

(52) U.S. Cl.

CPC ..... *B21C 23/22* (2013.01); *B21C 23/085* (2013.01); *B21C 23/12* (2013.01); *B21C 25/08* (2013.01); *B21C 33/004* (2013.01); *B21C 35/023* (2013.01)

(58) Field of Classification Search

CPC ..... B21C 23/02; B21C 23/085; B21C 23/12; B21C 23/217; B21C 23/22; B21C 23/24; B21C 25/04; B21C 25/08; B21C 35/023; B21C 33/004; B21C 37/154

See application file for complete search history.

(56) References Cited

U.S. PATENT DOCUMENTS 2,986,273 A * 5/1961 Bardgett ..... B21C 23/22 228/155
3,040,780 A * 6/1962 Sirois ..... B21C 23/22 138/115
3,422,648 A * 1/1969 Lemelson ..... B21C 23/085 264/171.12
4,598,856 A 7/1986 Bilbao-Eguiguren et al.

(Continued)

FOREIGN PATENT DOCUMENTS

CN 101181771 A 5/2008
CN 101912891 B 11/2011

(Continued)

*Primary Examiner* — Edward Tolan

(74) *Attorney, Agent, or Firm* — Juan Carlos A. Marquez; Marquez IP Law Office PLLC

(57) ABSTRACT

A composite tube manufacturing method includes the following steps: providing a billet, wherein the billet includes an inner material and an outer material, and the inner material is enveloped in the outer material; heating the billet; pushing the billet to a to-be-extruded position; and performing an extrusion process, and extruding the billet to a composite tube, wherein the inner material and the outer material of the billet are respectively extruded to an inner tube and an outer tube of the composite tube, and the outer tube is bonded to the inner tube through the extrusion process.

3 Claims, 8 Drawing Sheets

(56) References Cited

U.S. PATENT DOCUMENTS

| | | | | | |
|---|---|---|---|---|---|
| 5,775,155 | A * | 7/1998 | Kato | B21C 25/08 | 72/260 |
| 6,572,357 | B2 * | 6/2003 | Bailey | B01D 53/885 | 264/177.12 |
| 2015/0298189 | A1 * | 10/2015 | Lee | B21C 23/22 | 72/272 |

FOREIGN PATENT DOCUMENTS

| | | | | |
|---|---|---|---|---|
| CN | 103920734 | A | 7/2014 | |
| DE | 1783110 | B1 * | 3/1971 | B21C 23/22 |
| JP | 3-052708 | A * | 3/1991 | B21C 23/22 |
| JP | 9-253736 | A * | 9/1997 | B21C 23/00 |
| TW | 449560 | | 8/2001 | |

* cited by examiner

COMPOSITE TUBE AND MANUFACTURING METHOD THEREOF

CROSS-REFERENCE TO RELATED APPLICATION

This application claims the benefit of Taiwan Patent Application No. 103141765, filed on Dec. 2, 2014, which is hereby incorporated by reference for all purposes as if fully set forth herein.

BACKGROUND

Technical Field

The present invention relates to a composite tube and a manufacturing method thereof, and in particular, to a composite tube and a manufacturing method thereof, an outer tube and an inner tube of the composite tube being firmly bonded at an interface.

Related Art

An extrusion process refers to shaping a material in an extrusion manner. A principle thereof is moderately heating and exerting force on an extrusion material/billet, and forcing it through a die at uniform speed to manufacture a product of a required shape and size, and with required physical properties; therefore, the extrusion process is applicable to manufacturing of an easily shaped metal and plastic product.

Taiwan Patent Publication No. 449560 discloses a method for manufacturing bicycle tubing, which includes the following steps: placing a hollow metal tube into a hollow aluminum tube; providing a die having a tubular slot, the tubular slot having an opening; and taking a stamping action so that an entire outer surface of the metal tube is completely and closely attached to an inner wall of the aluminum tube. In this way, the metal tube and the aluminum tube are integrated into a whole. This patent describes a stamping process in which the entire outer surface of the metal tube is completely and closely attached to the inner wall of the aluminum tube, but does not disclose an extrusion process in which the metal tube and the aluminum tube are integrated into a whole.

Therefore, it is required to provide a composite tube manufacturing method, so as to resolve the foregoing problem.

SUMMARY

One objective of the present invention is to provide a composite tube manufacturing method, wherein an outer tube and an inner tube of the composite tube are firmly bonded at an interface.

According to the foregoing objective, the present invention provides a composite tube manufacturing method, comprising the following steps: providing a billet, wherein the billet comprises an inner material and an outer material, and the inner material is enveloped in the outer material; heating the billet; pushing the billet to a to-be-extruded position; and performing an extrusion process, and extruding the billet to a composite tube, where the inner material and the outer material of the billet are respectively extruded to an inner tube and an outer tube of the composite tube, and the outer tube is bonded to the inner tube through the extrusion process.

The composite tube of the present invention can be used as a bicycle tube, and has product properties such as light weight, high strength, damping, surface corrosion resistance, nice appearance, and high interface bonding strength; and therefore the composite tube can be applied to an assembly or a product with a damping requirement in future, such as cars or mechanical devices. The composite tube of the present invention replaces a simplex steel material or aluminum material, and achieves an objective of light weight and further reserves a certain carrying capability, thereby increasing an additional value of the bicycle tube.

DETAILED DESCRIPTION

To make the foregoing objectives, characteristics and features of the present invention more comprehensible, related embodiments of the present invention are described in detail below with reference to the accompanying drawings.

Figure 1:
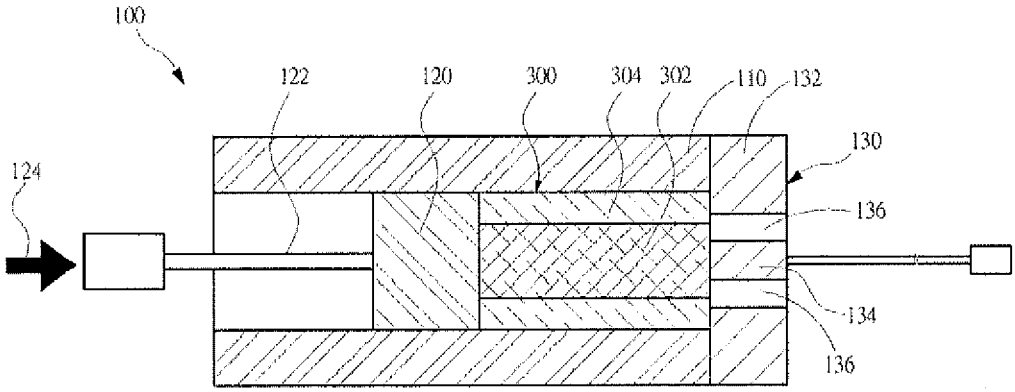
FIG. 1 is a schematic sectional view of an extrusion device according to a first embodiment of the present invention.

FIG. 1 is a schematic sectional view of an extrusion device according to a first embodiment of the present invention. The extrusion device 100 includes a billet container 110, an extrusion stem 120, and an extrusion die 130. The billet container 110 is used for accommodating a billet 300. The extrusion stem 120 is used for pushing and extruding the billet 300. The extrusion stem 120 may include a dummy (not shown), used for contacting the billet 300. The extrusion die 130 includes a first die 132 and a second die 134, wherein an outlet 136 is defined between the first die 132 and the second die 134. When the extrusion stem 120 extrudes the billet 300, the billet 300 is extruded to a composite tube according to a sectional shape of the outlet 136 of the extrusion die 130.

Figure 2A:
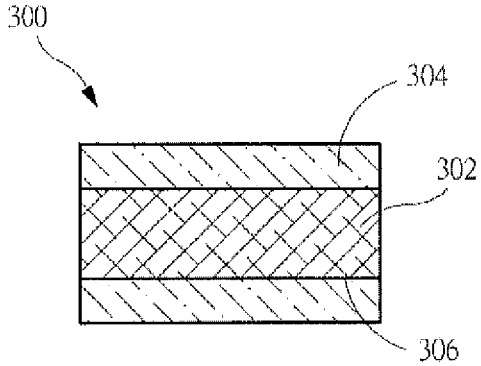
FIG. 2*a* and FIG. 2*b* are a sectional front view and a sectional side view of a billet according to an embodiment of the present invention.
Figure 2B:
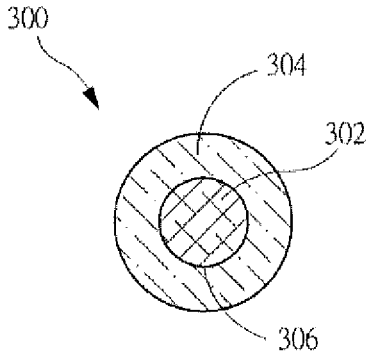

Referring to FIG. 2*a* and FIG. 2*b*, the billet 300 includes an inner material 302 and an outer material 304, wherein the inner material 302 is enveloped in the outer material 304. In this embodiment, the billet 300 may be in a cylinder shape; or, in another embodiment, the billet 300 may be in a rectangular prism shape (not shown). The outer material 304 includes a hollow inside 306, and the inner material 302 is located in the hollow inside 306. In this embodiment, the hollow inside 306 of the outer material 304 may be shaped in advance by using, for example, a machining process (for example, a drilling process) or a common tube manufacturing method.

Figure 3:
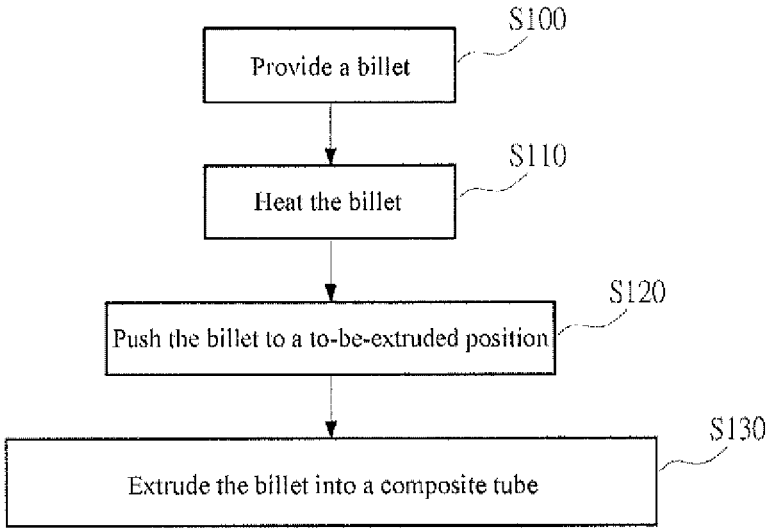
FIG. 3 is a flowchart of a composite tube manufacturing method according to a first embodiment of the present invention.

FIG. 3 is a flowchart of a composite tube manufacturing method according to the first embodiment of the present invention. The composite tube manufacturing method includes the following steps:

In Step S100, a billet 300 is provided, wherein the billet 300 includes an inner material 302 and an outer material 304, and the inner material 302 is enveloped in the outer material 304, as shown in FIG. 2*a* and FIG. 2*b*. In this embodiment, the inner material 302 and the outer material 304 may be made of a magnesium alloy and an aluminum alloy respectively; or, in another embodiment, the inner material 302 and the outer material 304 may be made of a magnesium alloy and a titanium alloy respectively.

In Step S110, the billet 300 is heated. Specifically, a heat treatment process is performed on the billet 300, which can change material properties of the billet 300, so that the billet 300 is easily processed. For example, in this embodiment, the billet 300 may include a magnesium alloy material and an aluminum alloy material, and after the heat treatment process, may be heated to achieve a temperature value below the melting point of the aluminum alloy material, to facilitate subsequent extrusion.

In Step S120, the billet is pushed to a to-be-extruded position, as shown in FIG. 1. In this embodiment, the billet 300 is placed in a billet container 110, and an extrusion stem 120 is used to push the billet 300 to the to-be-extruded position. The extrusion stem 120 may be driven by a first power source 122 along a first direction 124.

Figure 4A:
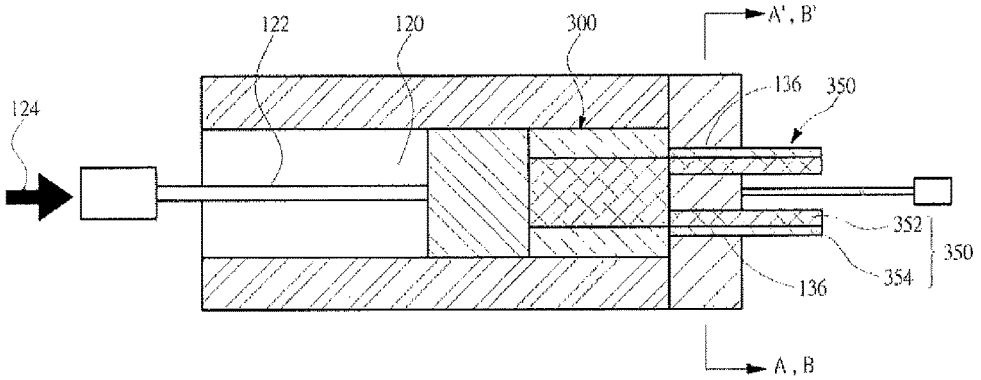
FIG. 4*a* is a schematic sectional view of a composite tube manufacturing method according to a first embodiment of the present invention, which shows an extrusion process.

In Step S130, an extrusion process is performed, wherein the billet 300 is extruded to a composite tube 350, as shown in FIG. 4*a*. In this embodiment, the extrusion stem 120 may be driven again by the first power source 122 along the first direction 124, and the extrusion stem 120 is used to extrude the billet 300, so that the billet 300 is extruded to the composite tube 350 according to a sectional shape of an outlet 136 of the extrusion die 130, wherein the outlet 136 is defined between a first die 132 and a second die 134 of the extrusion die 130. The first die 132 may be a fixed die, and the second die 134 may be a fixed die or a movable die. In addition, the extrusion process may include, for example, direct extrusion, indirect extrusion, and hydrostatic extrusion, but the present invention is not limited thereto. Finally, the composite tube 350 undergoes an aging treatment (cooling treatment) process and a cutting process, to form a functional composite tube.

Figure 4B:
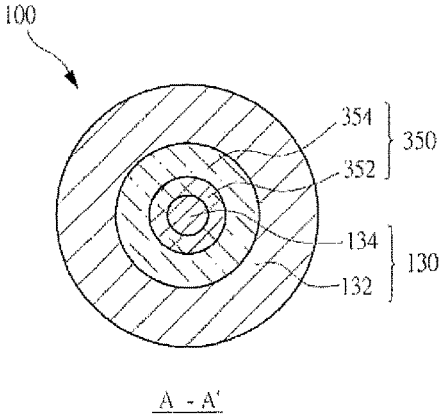
FIG. 4*b* is a schematic sectional view along a sectional line A-A' of an extrusion device in FIG. 4*a;*
Figure 4C:
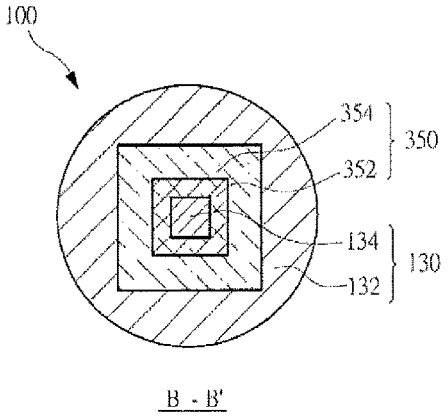
FIG. 4*c* is a schematic sectional view along a sectional line B-B' of an extrusion device in FIG. 4*a;*

In this embodiment, referring to FIG. 4*b*, a section of the composite tube 350 may be a circular tube; or, in another embodiment, referring to FIG. 4*c*, a section of the composite tube 350 may be a non-circular tube (that is, a special-tube section).

Figure 5:
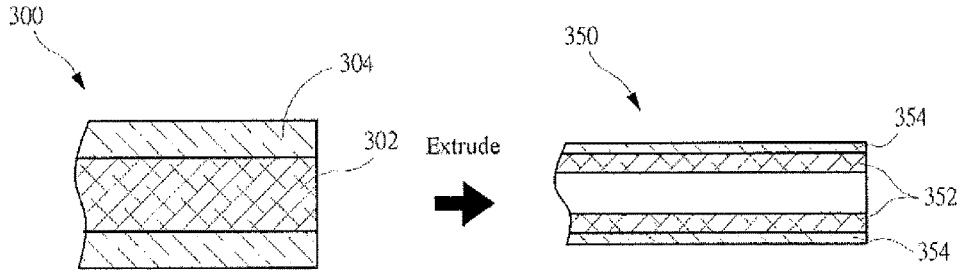
FIG. 5 is a schematic sectional view of a billet and a composite tube according to a first embodiment of the present invention.

Referring to FIG. 5, in a composite tube manufacturing method in the first embodiment of the present invention, the inner material 302 and the outer material 304 of the billet 300 are respectively extruded to an inner tube 352 and an outer tube 354 of the composite tube 350. The outer tube 354 is located outside the inner tube 352, wherein the outer tube 354 is bonded to the inner tube 352 through the extrusion process, and the outer tube 354 and the inner tube 352 are firmly bonded at an interface.

In this embodiment, the inner tube 352 and the outer tube 354 can be made of a magnesium alloy and an aluminum alloy respectively. For example, the inner material 302 and the outer material 304 may be made of AZ31 magnesium alloy and AA7005 aluminum alloy respectively (but the present invention is not limited thereto). Therefore, under force of 5000 psi, a damping capacity of the inner tube 352 made of the magnesium alloy is 25 times higher than that of the outer tube 354 made of the aluminum alloy, so as to suppress vibration. The damping capacity refers to a capacity of absorbing vibration in a heat energy manner when a material periodically vibrates under a stress below fatigue strength. Data about the damping capacity varies if the inner tube 352 made of the magnesium alloy is compared with the outer tube 354 made of the titanium alloy, and therefore, this embodiment merely describes data about the damping capacities of the inner tube 352 made of the magnesium alloy and the outer tube 354 made of the aluminum alloy. The tensile strength value of the outer tube 354 made of the aluminum alloy can be greater than 390 MPa, and the outer tube 354 is used to support the structure. Moreover, a difference value between melting points of the inner tube 352 and the outer tube 354 can be less than 200° C., so as to avoid that one of the inner material 302 and the outer material 304 are melted during heating of the billet 300. For example, the melting points of a magnesium alloy and an aluminum alloy are respectively 400° C. to 500° C. and 300° C. to 400° C., so that one of the magnesium alloy and the aluminum alloy is avoided being melted during heating of the billet 300.

The composite tube of the present invention can be used as a bicycle tube, and has product properties such as light weight, high strength, damping, surface corrosion resistance, nice appearance, and high interface bonding strength; and therefore the composite tube can be applied to an assembly or a product with a damping requirement in future, such as cars or mechanical devices. The composite tube of the present invention replaces a simplex steel material or aluminum material, and achieves an objective of light weight and further reserves a certain carrying capability, thereby increasing an additional value of the bicycle tube.

Figure 6:
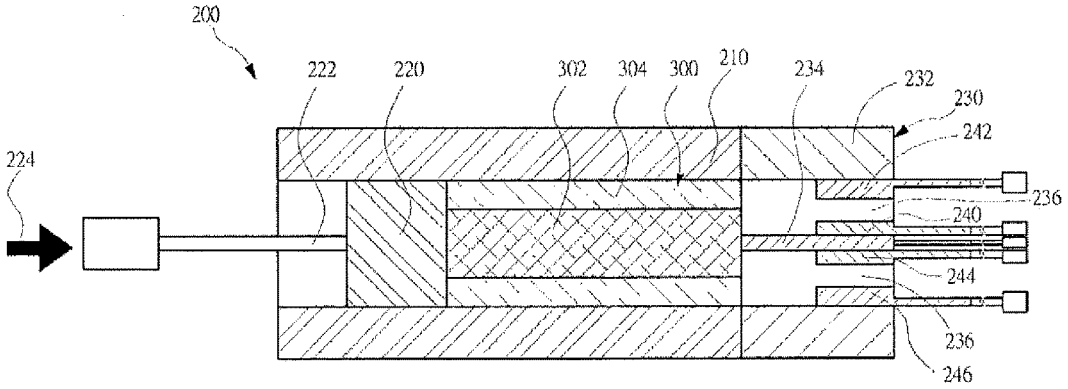
FIG. 6 is a schematic sectional view of an extrusion device according to a second embodiment of the present invention.

FIG. 6 is a schematic sectional view of an extrusion device according to a second embodiment of the present invention. The extrusion device 200 includes a billet container 210, an extrusion stem 220, and an extrusion die 230. The billet container 210 is used for accommodating a billet 300. The extrusion stem 220 is used for pushing and exerting force on the billet 300. The extrusion die 230 includes a first die 232 and a second die 234, wherein an outlet 236 is defined between the first die 232 and the second die 234. The extrusion device 200 further includes first to fourth mandrels 240, 242, 244, and 246, which pass through the outlet 236 of the extrusion die 230, so as to change an area of a section of the outlet 236 of the extrusion die 230. When the extrusion stem 220 extrudes the billet 300, the billet 300 is extruded to a composite tube according to a changed sectional shape of the outlet 236 of the extrusion die 230.

Figure 7:
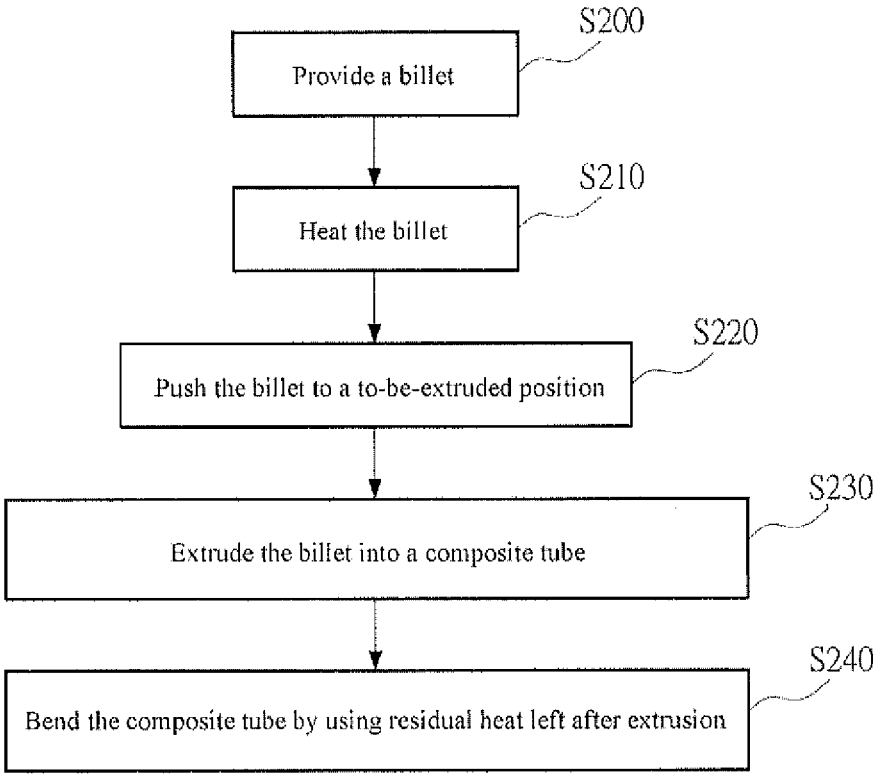
FIG. 7 is a flowchart of a composite tube manufacturing method according to a second embodiment of the present invention.

FIG. 7 is a flowchart of a composite tube manufacturing method according to the second embodiment of the present invention. The composite tube manufacturing method includes the following steps:

In Step S200, a billet 300 is provided, where the billet 300 includes an inner material 302 and an outer material 304, and the inner material 302 is enveloped in the outer material 304, as shown in FIG. 2*a* and FIG. 2*b*. In Step S210, the billet 300 is heated.

In Step S220, the billet 300 is pushed to a to-be-extruded position, as shown in FIG. 6. In this embodiment, the billet 300 is placed in a billet container 210, and an extrusion stem 220 is used to push the billet 300 to the to-be-extruded position. The extrusion stem 220 may be driven by a first power source 222 along a first direction 224.

Figure 8:
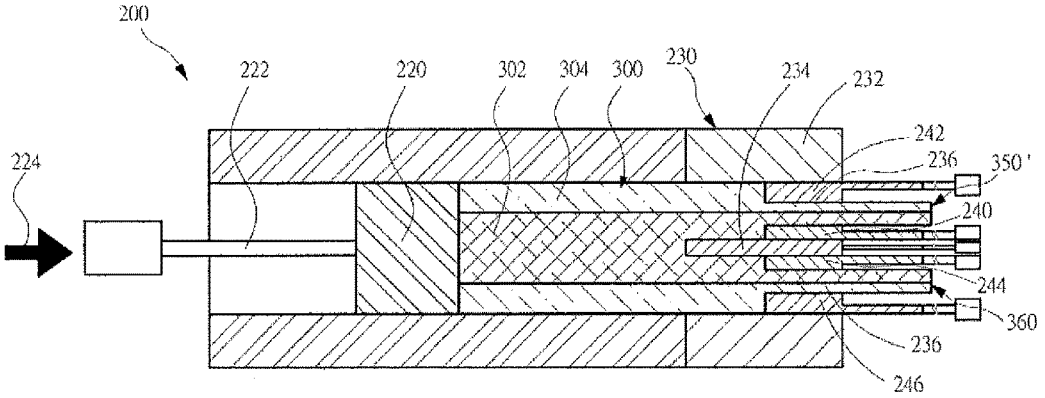
FIG. 8 and FIG. 9 are schematic sectional views of a composite tube manufacturing method according to a second embodiment of the present invention, which shows that at least one mandrel passes through an outlet of an extrusion die.
Figure 9:
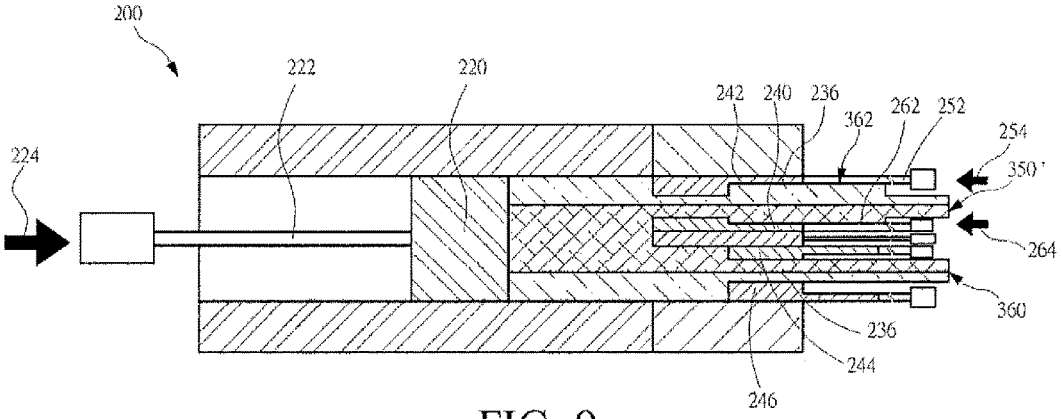

In Step S230, referring to FIG. 8 and FIG. 9, the billet 300 is extruded to a composite tube 350'. In this embodiment, the billet 300 is extruded, and at least one mandrel passes through the outlet 236 of the extrusion die 230, so as to change an area of a section of the outlet 236 of the extrusion die 230, so that the billet 300 is extruded to a composite tube 350' according to a changed sectional shape of the outlet 236 of the extrusion die 230. The at least one mandrel includes first to fourth mandrels 240, 242, 244, and 246, wherein the first and the third mandrels 240 and 244 make the composite tube 350' have different inner diameters, and the second and the fourth mandrels 242 and 246 make the composite tube 350' have different outer diameters.

For example, referring to FIG. 8, the extrusion stem 220 is driven by the first power source 222 along the first direction 224, so that the extrusion stem 220 extrudes the billet 300. Moreover, a thicker part of the first mandrel 240, a thicker part of the second mandrel 242, a thicker part of the third mandrel 244, and a thicker part of the fourth mandrel 246 pass through the outlet 236 of the extrusion die 230, so as to change an area of a section of the outlet 236 of the extrusion die 230, so that the billet 300 is extruded to a composite tube 350' with a first sectional shape 360 according to a changed sectional shape of the outlet 236 of the extrusion die 230. In this case, the changed sectional shape of the outlet 236 is determined between the first mandrel 240 and the second mandrel 242, and between the third mandrel 244 and the fourth mandrel 246.

Further referring to FIG. 9, when the extrusion stem 220 continuously extrudes the billet 300, the first mandrel 240 and the second mandrel 242 can be driven respectively by a second power source 252 and a third power source 262 along a second direction 254 and a third direction 264, and a thinner part of the first mandrel 240 and a thinner part of the second mandrel 242 pass through the outlet 236 of the extrusion die 230, so as to change an area of a section of the outlet 236 of the extrusion die 230, so that the billet 300 is extruded to a composite tube 350' with a second sectional shape 362 according to another changed sectional shape of the outlet 236 of the extrusion die 230. In this way, the composite tube 350' has different tube thickness, different inner diameters, or different outer diameters. In this case, the changed sectional shape of the outlet 236 is still determined between the first mandrel 240 and the second mandrel 242, and between the third mandrel 244 and the fourth mandrel 246.

Figure 10:
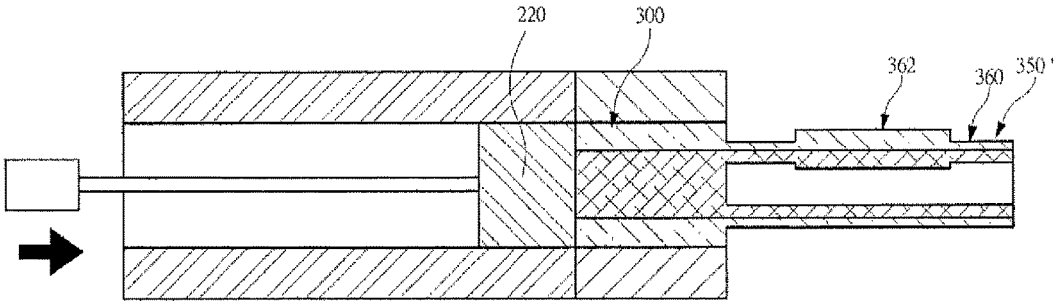
FIG. 10 is a schematic sectional view of a composite tube manufacturing method according to a second embodiment of the present invention, which shows that a second die, and first to fourth mandrels are removed.
Figure 11:
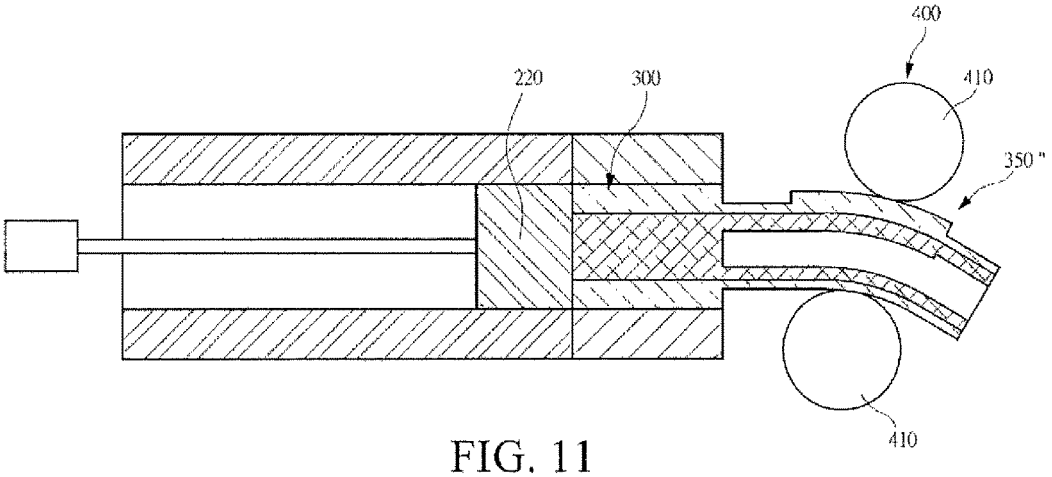
FIG. 11 is a schematic sectional view of a composite tube manufacturing method according to a second embodiment of the present invention, which shows bending of the composite tube.

In Step S240, the composite tube 350' is bent by using residual heat left after the extrusion, so that a bent composite tube 350" has a pre-determined curvature. In this embodiment, referring to FIG. 10, when the extrusion stem 220 extrudes the billet 300, the second die 234, and the first to the fourth mandrels 240, 242, 244, 246 are first removed, and then the subsequent bending process is performed on the composite tube 350'. Referring to FIG. 11, for example, two guiding pulleys 410 of a tube bending machine 400 can be used to bend the composite tube 350'; and the residual heat left after extrusion of the composite tube 350' can be used so that the composite tube 350' does not need to be additionally heated, thereby simplifying post processing. The bent composite tube 350" has a pre-determined curvature.

Figure 12:
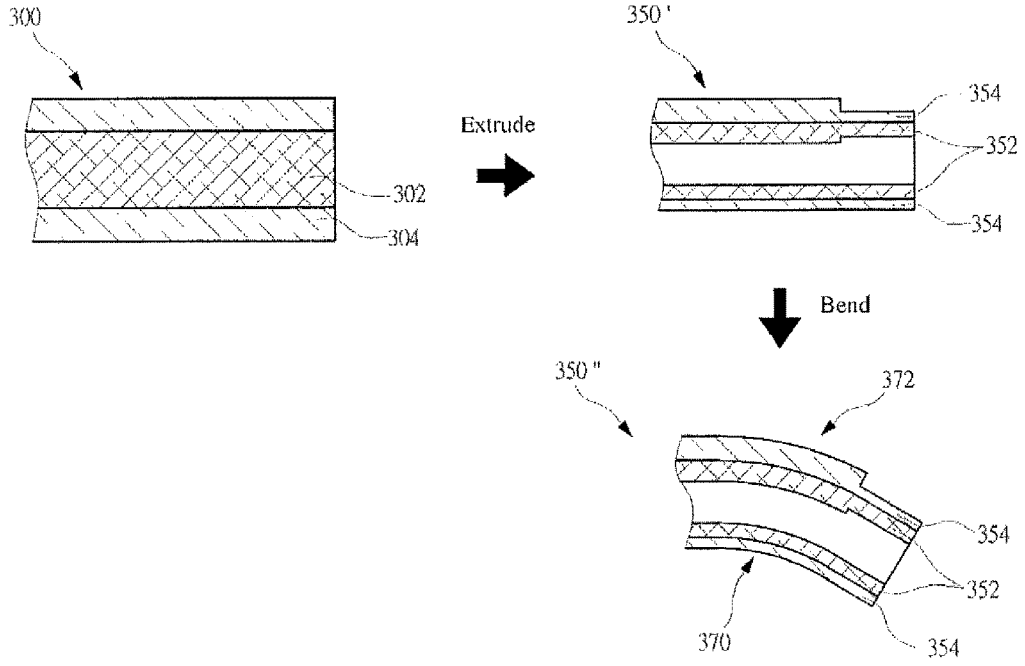
FIG. 12 is a schematic sectional view of a billet, a composite tube, and a bent composite tube according to a second embodiment of the present invention.

Referring to FIG. 12, in a composite tube manufacturing method in the second embodiment of the present invention, the billet including the inner material 302 and the outer material 304 is first extruded to the composite tube 350', and then the composite tube 350' is bent. A bent composite tube 350" includes an inner tube 352 and an outer tube 354, and the outer tube 354 is located outside the inner tube 352. During a bending process, because the composite tube 350" has a thicker part 372 and a thinner part 374, the thicker part 372 is adaptable to a tension action during bending and the thinner part 374 is adaptable to a compression action during bending, so as to avoid deformation or breaking of the composite tube 350".

To sum up, preferred implementation manners or embodiments of technical solutions adopted by the present invention to solve the problems are merely descried, and are not intended to limit the patent implementation scope of the present invention. Any implementation conforming to the patent implementation scope of the present invention, or equivalent variations and modifications made according to the patent scope of the present invention all fall within the patent scope of the present invention.

What is claimed is:

1. A composite tube manufacturing method, comprising the following steps:

providing a billet, wherein the billet comprises an inner material and an outer material, and the inner material is enveloped in the outer material;

heating the billet;

pushing the billet to a to-be-extruded position; and performing an extrusion process, and extruding the billet to a composite tube, wherein the inner material and the outer material of the billet are respectively extruded to an inner tube and an outer tube of the composite tube, and the outer tube is bonded to the inner tube through the extrusion process;

wherein the extrusion process comprises the following step: passing through an outlet of an extrusion die by at least one mandrel, so as to change an area of a section of the outlet of the extrusion die, so that the billet is extruded to the composite tube according to a changed sectional shape of the outlet of the extrusion die, wherein the at least one mandrel comprises first to fourth mandrels, the first and the third mandrels make the composite tube have different inner diameters, and the second and the fourth mandrels make the composite tube have different outer diameters.

2. The composite tube manufacturing method according to claim 1, wherein the step of pushing the billet to a to-be-extruded position comprises: placing the billet in a billet container, and pushing the billet to the to-be-extruded position by using an extrusion stem; and the extrusion process comprises the following step: extruding the billet by using the extrusion stem, so that the billet is extruded to the composite tube according to a sectional shape of an outlet of an extrusion die.

3. The composite tube manufacturing method according to claim 1, wherein the step of pushing the billet to a to-be-extruded position comprises: placing the billet in a billet container, and pushing the billet to the to-be-extruded position by using an extrusion stem.

* * * * *